US006957804B2

(12) United States Patent
Heggestad

(10) Patent No.: US 6,957,804 B2
(45) Date of Patent: Oct. 25, 2005

(54) BLADE INSTALLATION TOOL

(75) Inventor: Brent Heggestad, Medicine Hat (CA)

(73) Assignee: Brent's Grading Ltd., Medicine Hat (CA)

( * ) Notice: Subject to any disclaimer, the term of this patent is extended or adjusted under 35 U.S.C. 154(b) by 126 days.

(21) Appl. No.: 10/456,544

(22) Filed: Jun. 9, 2003

(65) Prior Publication Data

US 2003/0227011 A1 Dec. 11, 2003

(30) Foreign Application Priority Data

Jun. 10, 2002 (CA) ..... 2389957

(51) Int. Cl.[7] ..... B66D 1/26
(52) U.S. Cl. ..... 254/278; 254/283
(58) Field of Search ..... 254/278, 283, 254/291

(56) References Cited

U.S. PATENT DOCUMENTS

| | | | | |
|---|---|---|---|---|
| 410,507 | A * | 9/1889 | Fain | 254/278 |
| 1,887,487 | A | 11/1932 | Geer | |
| 2,538,061 | A * | 1/1951 | Torok | 254/294 |
| 2,686,659 | A * | 8/1954 | Bittner | 254/283 |
| 3,809,422 | A | 5/1974 | Schlough | |
| 3,868,189 | A | 2/1975 | King, Jr. | |
| 4,343,101 | A | 8/1982 | Klekamp et al. | |
| 4,422,228 | A | 12/1983 | Chapman et al. | |
| 4,881,769 | A | 11/1989 | Ims | |
| 5,071,183 | A | 12/1991 | McDermott et al. | |
| 5,149,057 | A * | 9/1992 | Meurer | 254/276 |
| 5,280,880 | A * | 1/1994 | Ewing et al. | 254/294 |
| 5,324,007 | A | 6/1994 | Freneix | |
| 5,890,546 | A | 4/1999 | Kerpash, Sr. | |
| 6,032,389 | A | 3/2000 | Perry et al. | |
| 6,092,316 | A | 7/2000 | Brinker | |
| 6,105,938 | A * | 8/2000 | Koida | 254/278 |
| 6,112,828 | A | 9/2000 | Leal | |
| 6,558,083 | B1 * | 5/2003 | Quandt | 405/218 |

OTHER PUBLICATIONS

Dan Brown; Grading & Excavation Contrator, Graders & Scrapers www.f rester.net/gx_0109_gr ders.html.
Paul Hull, Grading & Excavation Contractor, The Perfect Shape www.f rester.net/gx_0101_perfect.html.
Network International, Crawler Tractors, Crawler Loaders, Motor Scrapers.
Products www.b rl w rld-equipment.c m/b dy_pr ducts. html.

* cited by examiner

*Primary Examiner*—Emmanuel M Marcelo
(74) *Attorney, Agent, or Firm*—Bennett Jones LLP

(57) ABSTRACT

An apparatus for lifting and aligning a blade to a support, such as a grader moldboard or a scraper bowl. In one aspect the invention is an apparatus with a frame, flexible hoisting means for holding the blade, a drum to which each flexible hoisting means is attached, a stabilizing means for stabilizing the apparatus, and a drive means for rotating the drums. In another aspect, the invention is a method for lifting a blade to a support, which involves inserting flexible hoisting means through different apertures of a support and the corresponding apertures in the blade, and providing means to controllably reduce the length of the flexible hoisting means while holding the blade. The apparatus and method can be used by one person to lift, line up, and securely bolt a blade to a support.

30 Claims, 5 Drawing Sheets

BLADE INSTALLATION TOOL

FIELD OF THE INVENTION

The present invention relates to tools and methods for installing replaceable blades onto moldboards, bowls and the like, and removing them therefrom.

BACKGROUND OF THE INVENTION

Road graders and scrapers often have replaceable cutting blades that are attached to a moldboard or bowl, and which need to be replaced when worn out from contact with the ground surface. These blades are generally elongate metal bars that are mounted onto the moldboard or bowl, by bolting them thereto using a number of bolts that pass through corresponding apertures in the moldboard or bowl, and the blade.

Graders and scrapers are quite large and the blades are therefore large and heavy, making them difficult to replace. Not only must the blade be lifted to abut the moldboard or bowl but it must also be positioned properly such that the relatively small apertures in the moldboard or bowl and the blade line up. Then, it must be held in that position until at least a few of the bolts are in place. The blade replacement process is a difficult task that often requires the coordinated efforts of two or more persons, to ensure that the blade is not accidentally dropped before it is secured.

Often, one person operates a grader or scraper in a remote area. When the blade needs to be replaced the person must either replace it themselves, if possible, or call for another person to come to the site to assist in the replacement. What is needed in the art is a means for enabling one person to remove a used blade, and then lift, line up and securely bolt, a new blade to a moldboard or bowl in a manner that is easy, quick and avoids injury.

SUMMARY OF THE INVENTION

There is provided herein an apparatus and method by which one person can lift, line up and securely hold a blade to a moldboard, or to a bowl, until the blade is fastened to the moldboard.

In one aspect, this invention is an apparatus for moving an elongated blade that has a plurality of apertures, towards a support, that has a plurality of apertures that correspond with the apertures on the blade, said apparatus comprising:

(a) a frame;

(b) two flexible hoisting means, each having a free end and a fixed end, the free end and the flexible hoisting means being capable of passing through an aperture in the support and through a corresponding aperture in the support, and the free end being capable of being reversibly modified to prevent the slippage of the free end through the aperture in the blade after it has been inserted therethrough;

(c) a drum rotatably connected to the frame, to which the fixed end of each flexible hoisting means is attached, and around which the flexible hoisting means may be wound; and (d) a stabilizing means fastened to the apparatus, said stabilizing means being capable of stabilizing the apparatus when in use on a support.

In one embodiment, the apparatus additionally comprises a rotation control means for controlling the rotation of the drum. In one embodiment the rotation control means controls the rotation of the drums in one direction. In another embodiment the rotation control means controls the rotation of the drum in a selected one of two directions.

In yet another embodiment the apparatus comprises two drums, each said drum being positioned on the apparatus such that it will be above an aperture on the support when the apparatus is being used.

In one embodiment the stabilizing means is a stud. In another embodiment the apparatus comprises two studs, each said stud being positioned on the apparatus such that it will securely engage an aperture on the support when the apparatus is being used. In another embodiment, the apparatus comprises both two drums, and two studs.

In another embodiment, the studs are comprised of two parts, a fixed part and a removable adapter part. In this embodiment, the adaptor part can be changed, so that the apparatus may be used with supports that have apertures of different diameters.

In another aspect, this invention is a method for lifting an elongated blade that has a plurality of apertures from the ground to a support that has a plurality of apertures that correspond with the apertures on the blade, said method comprising:

(a) providing two flexible hoisting means, each said hoisting means comprising a free end and a fixed end;

(b) inserting the free end of each flexible hoisting means through an aperture on the support, said apertures being different from one another;

(c) inserting the free end of each flexible hoisting means through a corresponding aperture on the blade;

(d) modifying the free end of each flexible hoisting means so that it is no longer capable of passing through the aperture on the blade;

(e) providing a drum to which each fixed end is attached, and onto which each flexible hoisting means can be wound;

(f) winding the flexible hoisting means onto the drum until the blade abuts the support; and (g) securing the blade to the support.

In one embodiment, this method involves the creation of a sling in which the blade can be cradled, so that the angle of the blade can be adjusted to ensure that it abuts the support at a selected angle.

In another aspect, this invention is a method for lowering an elongated blade from a support to the ground.

DETAILED DESCRIPTION OF PREFERRED EMBODIMENTS

Reference will now be made to FIGS. 1 to 4, which show various embodiments of the invention. Although described herein as being used to lift or lower a blade of a grader to a moldboard, it is apparent that the apparatus could be used to lift or lower a replaceable blade of a scraper, of a snow wing, or other types of machines, to a support, such as a bowl, to which the blade will be attached.

Figure 1:
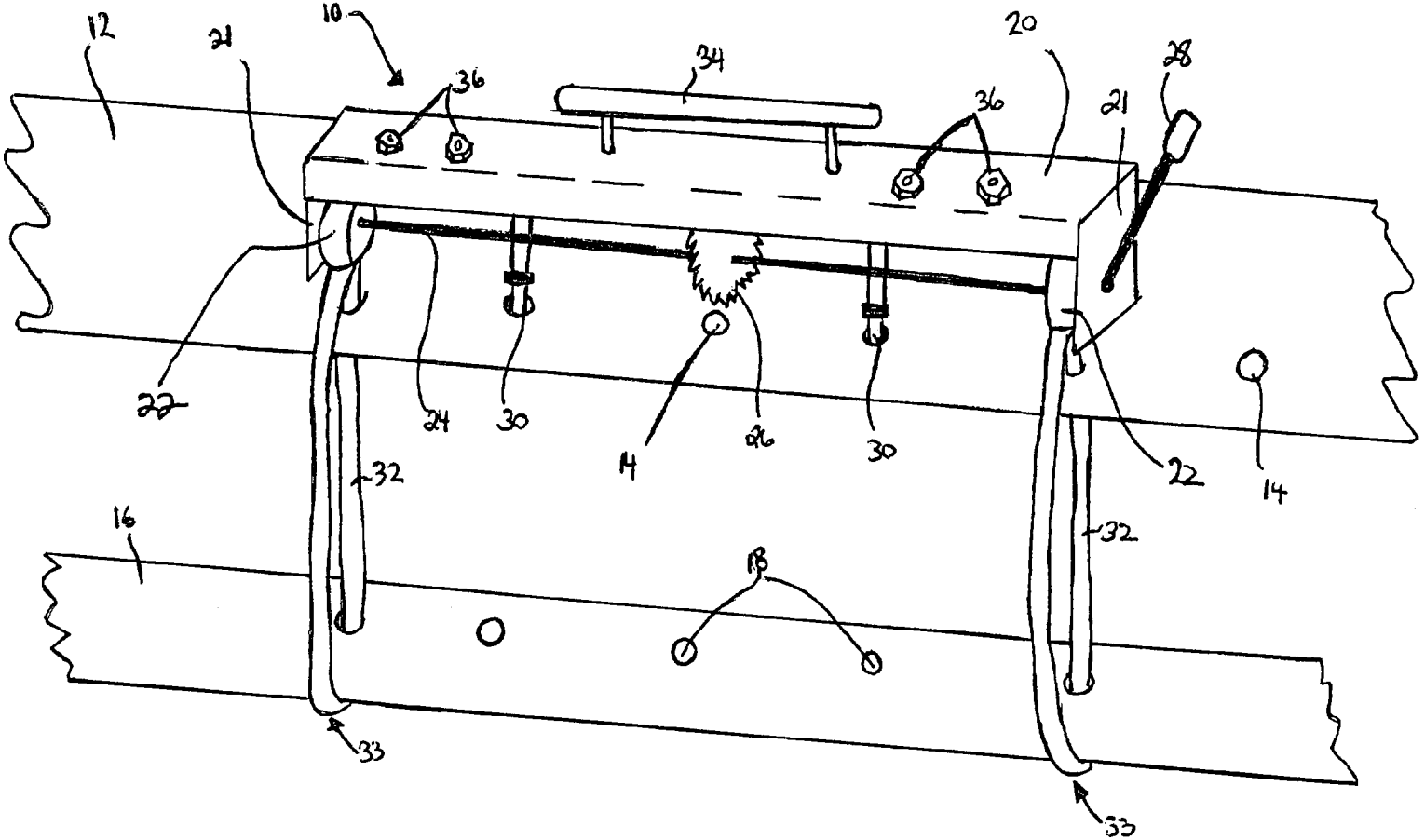
FIG. 1 is a front perspective view of an embodiment of the apparatus of this invention.

FIG. 1 shows apparatus 10 mounted onto a moldboard 12 and supporting a blade 16. Moldboard 12 has a plurality of apertures 14 that correspond with a plurality of apertures 18 on blade 16. Apparatus 10 comprises a frame 20, two drums 22, a drive shaft 24, a rotation control means 26, which in this embodiment is a ratchet, a lever 28 and studs 30. Studs 30 securely engage apertures 14, and correctly position apparatus 10 for use. Each drum 22 has a flexible hoisting means 32, which in this embodiment is a strap, and which is capable of passing through apertures 14 and 18. The drums 22 are fixed to and coaxially disposed about shaft 24, which shaft is driven to rotate about its longitudinal axis by pivotally mounted operating lever 28. The rotation of shaft 24 causes the drums 22 to rotate, and therefore straps 32 will wind onto or off of the drum, depending upon the direction of rotation. Rotation control means 26 is also fixed to and coaxially disposed about shaft 24, and functions to prevent uncontrolled rotation of the shaft, when the apparatus is in use. Apparatus 10 may include a handle 34 and stud storage means 36.

Frame 20 is an elongate support member that must be strong enough to support the various components of apparatus 10, when the apparatus is being used to lift or lower a blade 16. A blade 16 can weigh 125 pounds or more, and therefore frame 20 must be able to withstand this weight. The inventors have found that a frame 20 made from iron will provide the required support. However, other metals, or wood, or synthetic materials, such as plastic and plexiglass, may be used to make frame 20, provided that they have sufficient strength to withstand the lifting of a blade.

Frame 20 rests upon the upper surface of moldboard 12 when apparatus 10 is being used to lift or lower blade 16, as shown in FIG. 1. Frame 20 is designed so that the drums 22 are able to rotate about their axes, in order to lift or lower the blade. Therefore the ends of the frame 20 have vertical spacing members 21, as shown in FIG. 1, which function to provide sufficient space between the moldboard and the drums 22, to allow the drums to rotate. As is apparent, the vertical spacing members 21 could be elsewhere disposed on the frame, for example towards, or at, the middle of the longitudinal axis of frame 20. There can be more than two vertical spacing members 21, for example as shown in embodiment 10*b* in FIG. 3, wherein there is a central vertical spacing member provided near rotation control means 26, which provides support for the center part of frame 20.

Shaft 24 is attached to, and supported by, frame 20 in such a manner that the shaft is capable of rotation about its longitudinal axis. In the embodiment shown in FIG. 1, shaft 24 is functionally attached at each end to the vertical spacing member 21. Shaft 24 passes through drums 22, and rotation control means 26, as shown in FIG. 1, and is fixed to the drums and the rotation control means so that, as shaft 24 is rotated by lever 28, the drums and the rotation control means rotate therewith to the same degree. One means of attaching drums 22 and rotation control means 26 to shaft 24 is by welding.

Shaft 24 must be sufficiently strong to withstand the forces applied to it when bit 16 is being hoisted toward moldboard 12. In this regard, 1"×¼" and 1¼"×¼" cold roll flat bar, a solid hexagonal shaft, or a round cold bar may be useful, depending upon the length of shaft 24, and other features of the apparatus.

Figure 2:
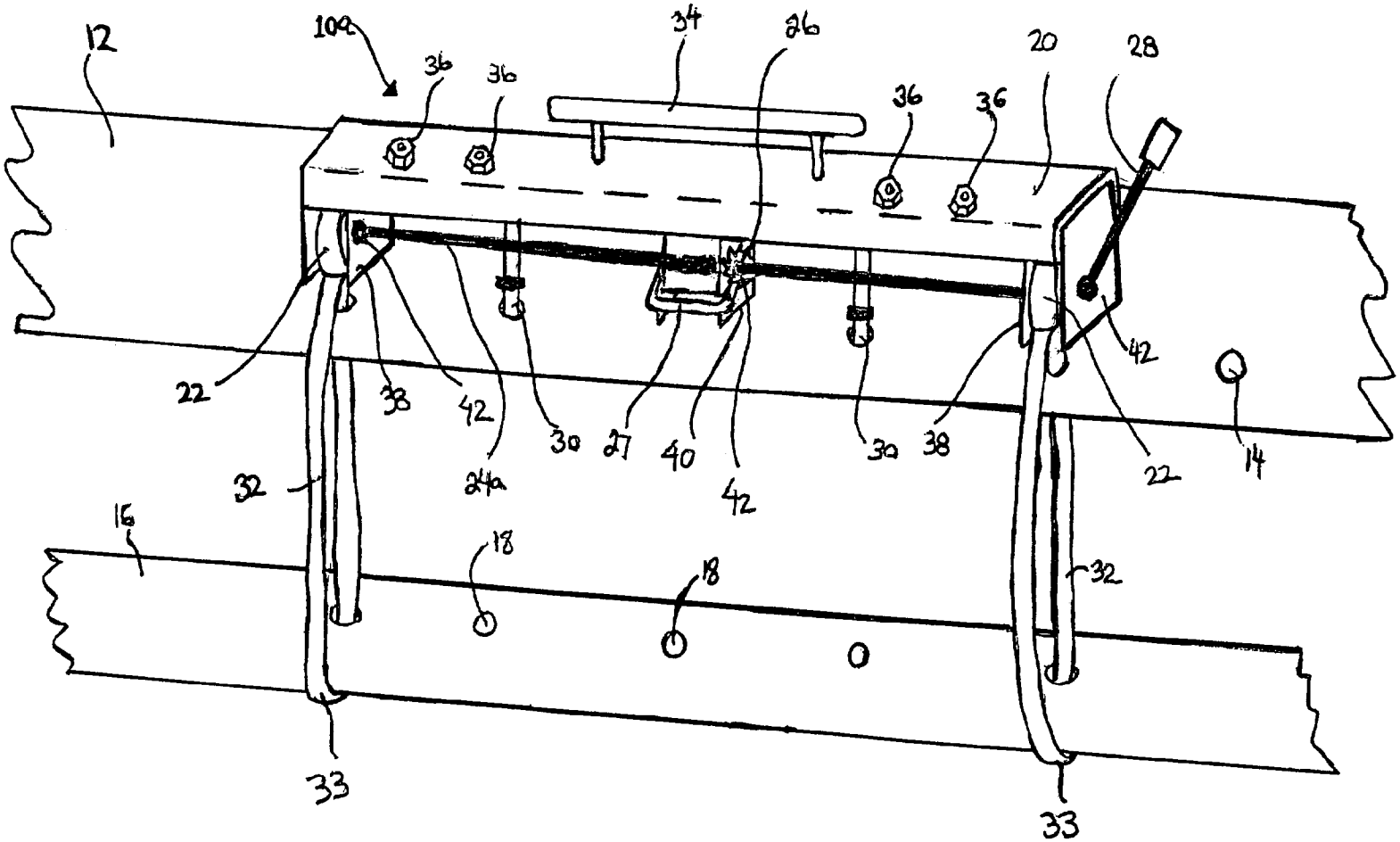
FIG. 2 is a front perspective view of an embodiment of the apparatus of this invention.

Instead of comprising a one-piece unit as shown in FIG. 1, shaft 24 may comprise several portions 24*a* that are functionally joined together to rotate in unison with one another, as shown in embodiment 10*a*, in FIG. 2. In this embodiment, drums 22 and rotation control means 26 comprise independent units that are carried within separate frames, 38 and 40 respectively, that are welded to frame 20. Each of the drums 22 or the rotation control means 26 rotate within their respective frames, and can be activated to rotate via an activator 42, that functionally connects drum 22 or rotation control means 26 to shaft portion 24*a*, so that they rotate therewith. In one embodiment, the activator 42 is two ½ moon pieces of key stock separated by ¼", and mounted to the sides of the frame 38 or 40.

Shaft portions 24*a*, must be sufficiently strong to withstand the forces applied to them when blade 16 is being lifted or lowered. In this regard, 1"×¼" and 1¼"×¼" cold roll flat bar have been found to be useful. The pieces of cold roll flat bar are cut to the appropriate length, so that they extend the distance between, and functionally interconnect, the activators 42 of frames 38 and 40.

Figure 4:
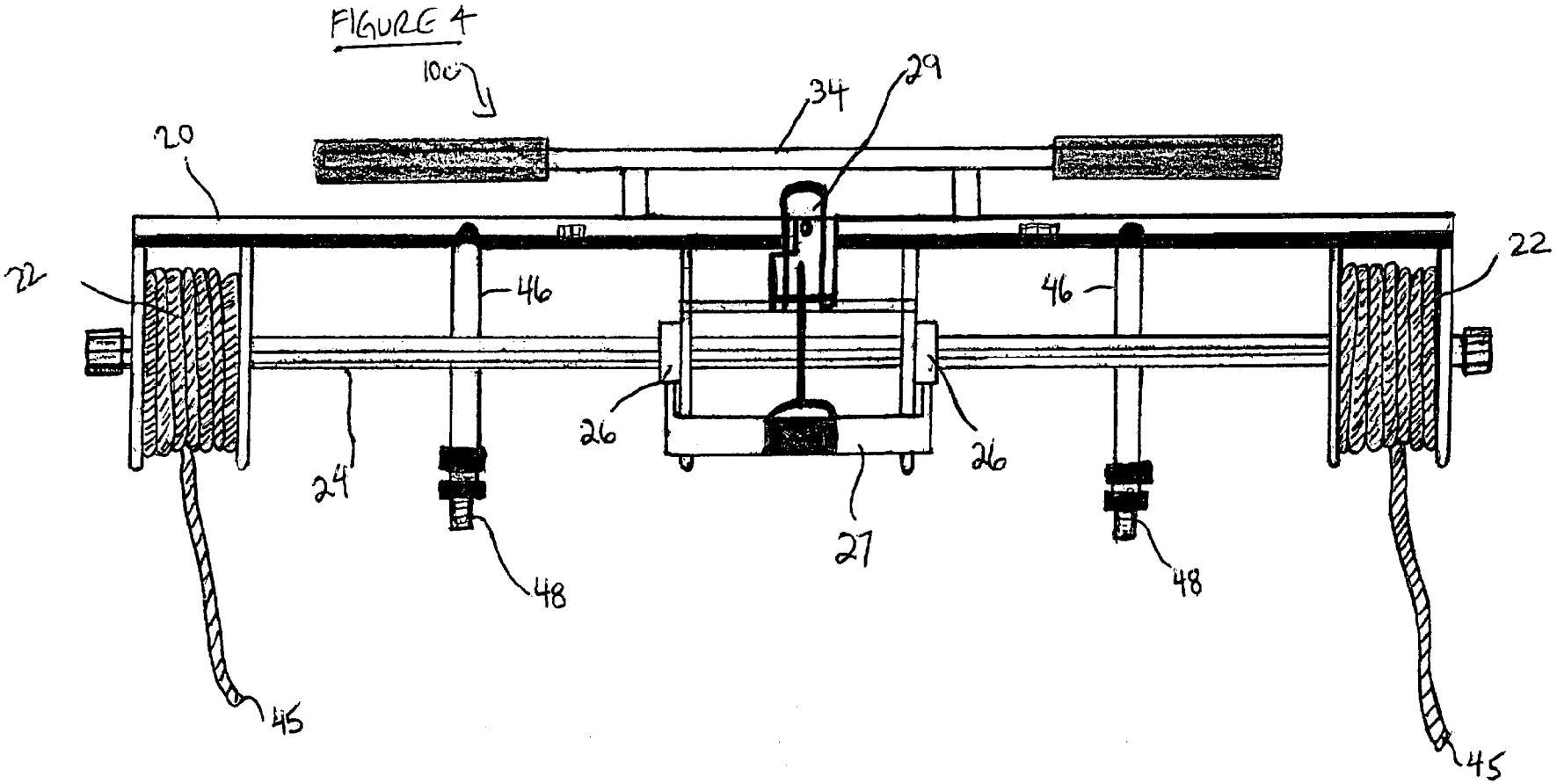
FIG. 4 is a front elevation view of an embodiment of the apparatus of this invention.

In the embodiment shown in FIGS. 1 and 2, the rotation control means 26 is a ratchet, which is a wheel or other structure with teeth on its outer surface that interact with a loose, pivoted pawl 27. The pawl is a pivoted catch, latch or cog that is yieldingly urged, as by a spring, to engage the teeth on the ratchet to prevent the rotation of the ratchet, and therefore shaft 24. Therefore, the ratchet and pawl prevent uncontrolled rotation of the shaft when the blade is being lifted or lowered. In one embodiment of this device, the ratchet is a Klingspor™ PS33 150 Klingon Disc, which comprises a substantially square metal frame with a toothed wheel on either side of the frame, and a pivoted spring-activated pawl 27 that engages the teeth on both of the toothed wheels simultaneously. This rotation control means 26 is shown in FIG. 2 or 4. The embodiment of the apparatus shown in FIG. 4 includes a latch 29, that can be used to disengage the pawl 27 from the ratchet 26, and thereby allow free rotation of the shaft 24.

In one embodiment the rotation control means 26 functions to prevent the unrestricted rotation of the shaft 24 in one direction only, and can be used therefore, to prevent the blade from falling when it is being lifted towards the moldboard. In an alternative embodiment, the rotation control means 26 functions to prevent the unrestricted rotation of shaft 24 in a selected one of both directions of rotation, and can therefore be used to control both the lifting and the lowering of blade 16. Although shown and disclosed herein as a ratchet, any device or combination of devices that would control the rotation of shaft, is intended to be included herein.

An example of the assembly of embodiment 10*a* that the inventors have used, is herein provided. Frame 20 comprises 4" channel iron, cut to an appropriate length, to which is welded the frames 38 and 40. One source of the drums and rotation control means, in a frame, is the Klingspor™, PS33 150 Klingon Disc. In order to make the drums 22 on either end of apparatus 10*a*, the pawl 27 on the PS33 150 Klingon Disc is removed. The shaft portions 24*a* comprise 1¼"×¼" cold roll flat bar, inserted into the ¼" space between the two ½ moon pieces of key stock on the PS33 150 Klingon Disc, and bolted thereto.

Lever 28 is pivotally mounted and functionally connected to shaft 24, such that it will cause shaft 24 to rotate when actuated. Other means of causing shaft 24 to rotate are intended to be included herein, for example, lever 28 may be replaced by an electric or hydraulic device that rotates shaft 24. Note that, depending upon what type of means are used to rotate the shaft 24, the apparatus of this invention may or may not need to have a rotation control means 26. For instance, if the shaft is rotated by an electric device, rather than a lever, the device may lift the blade in one continuous and controlled motion, and therefore the rotation control means 26 may be dispensed with, as there will be little risk of uncontrolled rotation.

The drums 22 rotate in unison, as they are both securely fixed to shaft 24 and therefore move in coordination therewith, as lever 28 is pivoted. Wound around the drums is a flexible hoisting means 32, such as a cable, rope, chain, strap or belt, as shown in the embodiments disclosed in FIGS. 1–4. In these embodiments, drums 22 are positioned on shaft 24 at such a location that they are substantially above an aperture 14 on moldboard 12. In this position the flexible hoisting means will be easily and accurately wound onto drum 22, as blade 16 is being lifted towards moldboard 12.

The distance between drums 22 corresponds to the distance between apertures 14 of the moldboard on which apparatus 10 will be used. In one embodiment of this invention, shown in FIGS. 1 and 2, drums 22 are separated by a distance that is four times the distance between apertures 14. In conventional moldboards, the distance between two apertures 14 is about 6 inches, and therefore in this embodiment drums 22 would be separated by about 24 inches. As is apparent, drums 22 could be separated by a distance that is a multiple of about one, two, three, or more than four times, the distance between apertures 14. The present invention is not intended to be limited by the distance between drums 22, provided that the apparatus will still function as intended herein at whatever distance is selected.

Although FIGS. 1 to 4 show an apparatus in which drums 22 are positioned at either end of shaft 24, this invention is intended to include embodiments in which the drums 22 are positioned closer to the middle of the apparatus, but still substantially above apertures 14.

In another embodiment, the drums 22 are not positioned substantially above an aperture 14 in the moldboard. Rather, only the flexible hoisting means 32 are positioned substantially above the apertures 14. This could be accomplished, for instance, by directing the flexible hoisting means 32 from the drums through a guide means, which guide means positions the flexible hoisting means 32 substantially above the apertures 14. What is important with regard to the positioning of the flexible hoisting means 32, is that the flexible hoisting means 32 be able to pass through at least two different holes in the moldboard, and this is easily accomplished by placing the drums 22 above the apertures 14. If the flexible hoisting means 32 pass through only one aperture 14, the blade will be capable of pivoting around that point as it is being lifted or lowered, and may cause damage to equipment or injury to workers. By passing through at least two apertures 14, the ability of blade 16 to pivot is thereby reduced.

The flexible hoisting means 32 is comprised of material that, recognizing that at least two flexible hoisting means 32 are used in this invention, is strong enough to support blade 16 while it is suspended. Each flexible hoisting means 32 comprises a free end 45. In order to use apparatus 10, free end 45 is passed through apertures 14 and 18, and then modified in some manner so that it will not slip out of aperture 18 when the user is lifting or lowering blade 16. In this regard then, free end 45 must be capable of being reversibly modified in some manner, to prevent it from slipping out of aperture 18, after it is inserted therethrough.

In one embodiment, flexible hoisting means 32 is a strap. After insertion of the strap through aperture 14 as shown in FIGS. 1 and 2, free end 45 is brought back up to the drum 22. At drum 22, the free end is modified by winding it around the drum in such a manner that, when the drum is turned to lift the blade, the free end will turn therewith. This can be accomplished, for example, by inserting the free end 45 between the drum 22 and the flexible hoisting means 32, such that when the drum is turned, the free end becomes trapped between the drum and flexible hoisting means, and turns therewith.

Figure 3:
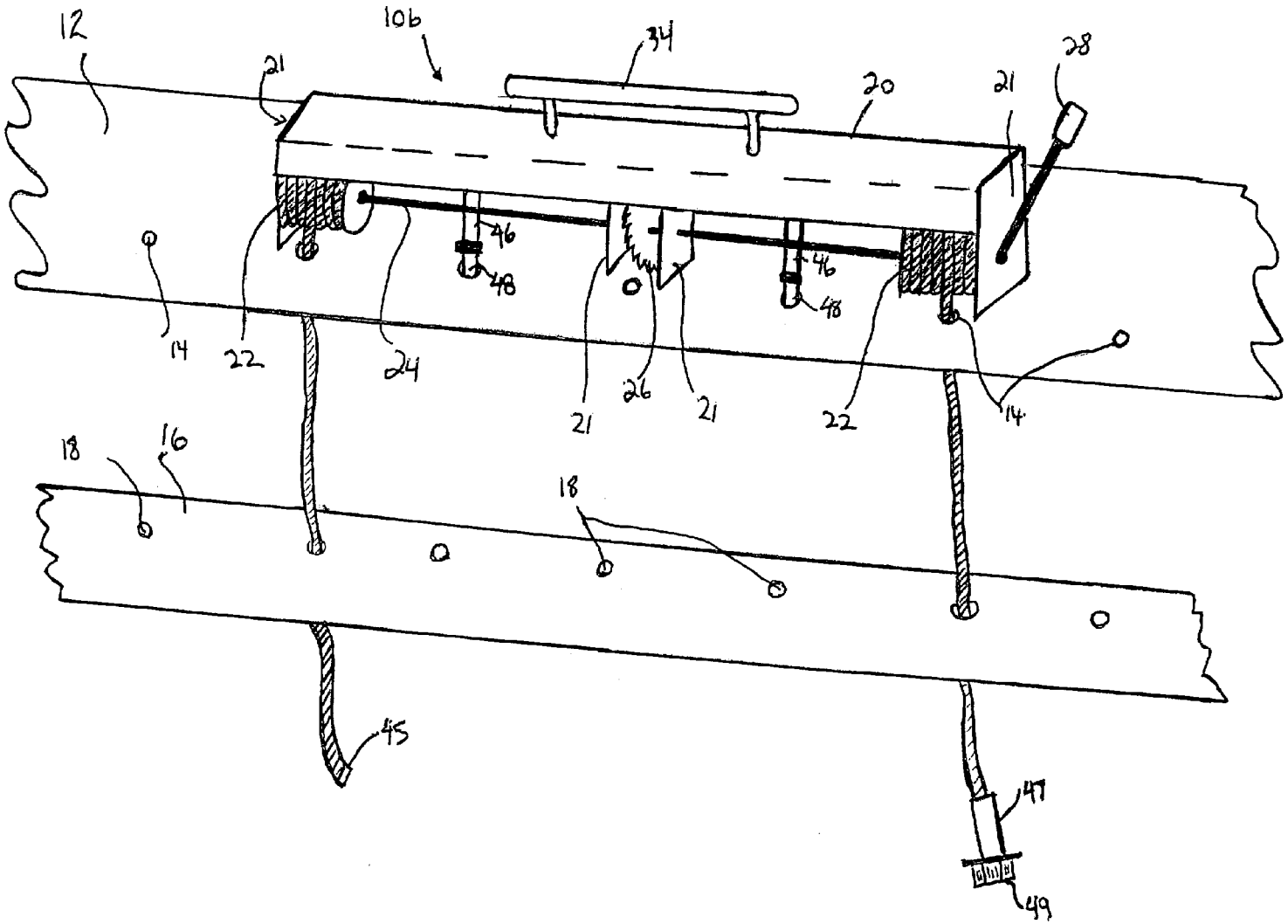
FIG. 3 is a front perspective view of an embodiment of the apparatus of this invention.

In another embodiment, the free end 45 may be reversibly secured to the moldboard, the blade, or to some part of the apparatus itself in order to prevent it from slipping out of an aperture 18 after it is inserted therethrough. One way of accomplishing this is to increase the diameter of the free end, for example by tying a knot in it, which will, for example, secure the free end to the underside of the blade. Alternatively, as shown in FIG. 3, free end 45 may be modified to include a terminal 47 to which a fastening device 49 that is larger than aperture 18, can be attached, as by threading onto the terminal. This fastening device will be incapable of passing through the aperture in the bit, or through another aperture that can be formed on the apparatus itself.

It is preferred to restrain the free end 45 at or near the drum, so that the flexible hoisting means 32 forms a sling 33 that cradles the blade, as seen in FIGS. 1 and 2. If this means of securing the free end is used, the angle of blade 16 can be adjusted while it is in the sling, before it abuts moldboard 12. This will help to ensure that the moldboard and blade meet at an angle that will enable them to be bolted together easily and efficiently.

While the invention has been described herein as having two drums 22 and two flexible hoisting means 32, it is understood that more drums and more flexible hoisting means may be used. As is also apparent, both flexible hoisting means may be rolled onto one drum 22, if they are otherwise appropriately positioned for insertion into apertures 14.

Studs 30 are longitudinal members oriented so that they will engage apertures 14 in moldboard 12. Studs 30 function to align apparatus 10 with respect to apertures 14, and to prevent apparatus 10 from moving out of alignment with apertures 14 when it is being used. Additionally, studs 30 assist in preventing the apparatus from flipping about its longitudinal axis when it is being used. Therefore studs 30 are sufficiently long, and of a suitable diameter to securely engage apertures 14, and perform these functions. As is apparent, studs 30 are longer than vertical spacing members 21, in order to be able to be received in apertures 14. Studs 30 may also be of a length sufficient to enable them to be received in apertures 18 of blade 16.

Studs 30 may be of any shape in cross-section, including round, oval, square and rectangular, that will permit them to securely engage apertures 14. The studs are comprised of a material that will provide sufficient strength to prevent them from breaking when apparatus 10 is being used. In one embodiment, studs 30 are made of iron, however, other metals, or wood, or synthetic materials, such as plastic and plexiglass may be used, provided that they have sufficient strength. The studs 30 are fastened to frame 20, for example by welding to frame 20, or by threading into a nut that is welded to frame 20.

Figure 5:
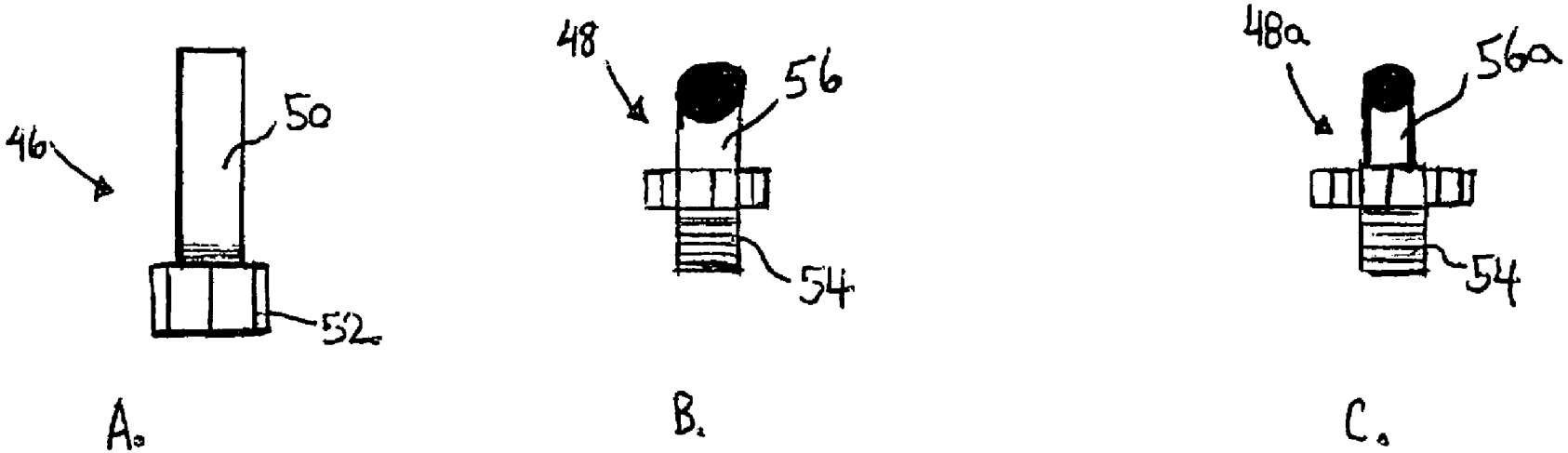
FIGS. 5A–C are side elevation views of embodiments of the stud of this invention.

In one embodiment shown in FIGS. 5A–C, studs 30 are comprised of two parts, fixed part 46 and adaptor 48, that are connected together to form the studs 30. Fixed part 46 has a spacer 50 and connector 52. Spacer 50 is fastened, as by welding, to frame 20. Connector 52 comprises a means of securely and reversibly connecting fixed part 46 to adaptor 48. In the embodiment shown in FIG. 5, connector 52 comprises a nut, that is partially threaded onto spacer 50 and welded thereto.

Adaptor 48 comprises a connector 54 and an aperture-engaging portion 56. Adaptor 48 securely and reversibly connects to fixed part 46, for example by threading connector 54 into connector 52. Aperture-engaging end 56 is sized so as to securely engage an aperture on a moldboard. In one embodiment shown in FIG. 5B, aperture-engaging end 56 has a ¾ inch diameter, whereas in another embodiment, 48*a*, shown in FIG. 5C, aperture-engaging end 48*a* has a ⅝ inch diameter. Both of these diameters are the diameter of standard apertures in moldboards. The end user of apparatus 10 would have access to both adaptors 48 and 48*a*, and therefore could select an adaptor depending upon the size of the apertures in the moldboard. Therefore, one apparatus 10 could be used with moldboards that have a different aperture size.

As is apparent, the diameter of aperture-engaging end 56 is not limited to ¾" or ⅝" but could be any diameter that will securely engage an aperture of a moldboard, or bowl. Additionally, other means of securely connecting fixed part 46 and adaptor 48 to one another may be devised by those skilled in the art, and these means are intended to be included in the scope of this invention.

As mentioned above, studs 30 perform two functions, namely to position the apparatus before and during use, and to stabilize the apparatus so that it does not flip about its longitudinal axis, during use. The studs 30 may be replaced by other means for stabilizing the apparatus, for example magnets or clamps that clamp the apparatus to the moldboard. Alternatively the width of the base of the apparatus, being the part that contacts the moldboard, may be increased, for example by adding skis thereto. In one embodiment, the studs are dispensed with altogether, as the apparatus is stabilized by some other means, and the positioning function of the studs is provided by the flexible hoisting means 32.

One embodiment of this invention, shown in FIGS. 1 and 2, provides a stud storage means 36, which stores adaptors 48 when they are not being used or when they are not connected to fixed part 46. In this embodiment, adaptor 48 is threaded, via its connector 54, into the stud storage means, which is shown in FIGS. 1 and 2 as a nut. As is apparent, the stud storage means 36 may be designed to co-operate with whatever means is used to securely connect fixed part 46 and adaptor 48 together.

In the embodiment shown in FIG. 1, studs 30 are attached to frame 20 at two positions that lie between drums 22. However, the two studs 30 could be positioned anywhere along the longitudinal axis of frame 20, including on the outside (as in FIG. 1) of drums 22, provided that apparatus 10 will still function as indicated herein.

In one embodiment of this invention apparatus 10 comprises only one stud 30, and in yet another embodiment, three or more studs. These studs can be positioned anywhere along the longitudinal axis of frame 20, provided they are able to engage the apertures 14. The present invention is not intended to be limited by the number of studs 30, provided that the apparatus will function as intended herein, using the selected number of studs.

The distance between studs 30 will correspond to the distance between apertures 14 of the moldboard on which apparatus 10 will be used. In one embodiment of this invention, shown in FIGS. 1 and 2, studs 30 are spaced apart a distance that is twice the distance between apertures 14. For conventional moldboards therefore, the studs in this embodiment would be separated by about 12 inches. In other embodiments, the studs 30 may engage adjacent apertures, or they may be separated by more than twice the distance between apertures 14. The present invention is not intended to be limited by the distance between studs 30, provided that the apparatus will still function as intended herein at the selected distance.

In one embodiment apparatus 10 comprises a handle 34 that is used to carry the apparatus.

Having thus described various embodiments of the apparatus 10, a method of lifting a blade to a moldboard will now be disclosed. The first step of this method is to position apparatus 10 on the top face of moldboard 12 by inserting studs 30 into apertures 14 of the moldboard. The moldboard will have any blades previously attached thereto removed.

A moldboard may require only one blade, or it may require two or more blades. In one embodiment of this method, apparatus 10 is positioned above the apertures 14 that would correspond with the apertures 18 that are approximately in center of the particular blade that is to be installed. An aperture 14 on the moldboard and an aperture 18 on the blade "correspond" when they are the apertures that are connected by the same bolt, after the blade is bolted to the moldboard. By selecting apertures 14 that would correspond with apertures 18 that are in approximately the center of the particular blade 16, the blade will remain essentially level when it is being lifted upwards. As an example, a 12-foot moldboard generally requires two blades, each a length of six feet. Each blade will usually comprise thirteen apertures 18, of which the $7^{th}$ aperture is the center. Therefore, to mount the blade on the moldboard, using for example the embodiment of the apparatus 10 shown in FIG. 1, the apparatus would be positioned so that the studs 30 are in the $6^{th}$ and $8^{th}$ apertures 14 from one end of the moldboard, and the rotation control means 26 is positioned above the $7^{th}$ aperture.

The method described herein is not limited to the insertion of studs 30 into apertures 14 that correspond with apertures 18 positioned approximately in the center of the particular blade that is to be installed on the moldboard. Other apertures 14 can be used.

Upon insertion of the studs 30 into the apertures 14, the free ends 45 of the flexible hoisting means 32 will line up with apertures 14 through which they will be inserted. The next step of the method is to insert the free ends 45 through the apertures 14.

In another embodiment of the method of this invention, the first and second steps noted above are reversed. Therefore, the apparatus is approximately positioned over top of the apertures 14, and the flexible hoisting means are inserted through their respective apertures 14 before the studs 30 are inserted into the selected apertures 14 on the moldboard.

The next step is to insert the free ends 45 through the apertures 18 on the blade that correspond with the apertures 14 on the moldboard through which they were previously passed. The free ends are then secured to the drum, blade, moldboard or apparatus, as described above, to prevent them from slipping back through the apertures 18.

The next step is to rotate shaft 24 by actuating lever 28. Drums 22 will rotate, and the flexible support members 32 will be wound around drums 22 and thereby move the blade towards the moldboard. If free end 45 is secured in such a manner that a sling 33 is formed, the angle of the blade may be adjusted at any time before it abuts the moldboard. When blade 16 abuts moldboard 12, apertures 14 and 18 will be aligned. The user will then bolt together two or more apertures 14 and 18 that do not have a stud 30 or flexible hoisting means 32 extending therethrough.

The free ends 45 are then released, the flexible hoisting means 32 are removed from the apertures 14 and 18. The apparatus 10 is removed from the moldboard and any remaining apertures 14 and 18 are bolted together.

If the apparatus is to be used to remove a moldboard, the steps in the method described above are essentially reversed. This method would use an apparatus that has a rotation control means that controls the rotation of shaft 24 while the blade is being lowered.

While the invention has been described in conjunction with the disclosed embodiments, it will be understood that the invention is not intended to be limited to these embodiments. On the contrary, the invention is intended to cover alternatives, modifications, and equivalents, which may be included within the spirit and scope of the invention as defined by the appended claims. For example, to be used to mount a blade onto a snow-wing, the apparatus may be adapted in order to enable the studs 30 to securely engage the apertures on the snow-wing. Such adaptations are intended to be included herein.

I claim:

1. An apparatus for moving an elongated blade that has a plurality of apertures, towards a support, that has a plurality of apertures that correspond with the apertures on the blade, said apparatus comprising:

(a) a frame;

(b) a shaft attached to the frame;

(c) at least two flexible hoisting means, each having a free end and a fixed end, the free end and the flexible hoisting means sized to pass through an aperture in the support and through a corresponding aperture in the blade;

(d) a drum mounted to the shaft, to which the fixed end of each flexible hoisting means is attached;

(e) a drive means for rotating the shaft mounted to the shaft, and (f) a stabilizing means that stabilizes the apparatus when in use on the support.

2. The apparatus of claim 1, wherein the drum is a first drum, to which the fixed end of one flexible hoisting means is attached, further comprising at least a second drum mounted to the shaft, to which the fixed end of the other flexible hoisting means is attached.

3. The apparatus of claim 2, further comprising a rotation control means for controlling the rotation of the first and second drum.

4. The apparatus of claim 3, wherein the rotation control means controls the rotation of the drums in a selected one of two directions.

5. The apparatus of claim 3, wherein the first drum and second drum are each mounted in a drum frame, and the drum frames are fixed to the frame.

6. The apparatus of claim 5 wherein the rotation control means is mounted in a rotation frame, and the rotation frame is mounted to the frame.

7. The apparatus of claim 6, wherein the shaft is comprised of several sections that rotate in unison.

8. The apparatus of claim 3, wherein the rotation control means is a ratchet.

9. The apparatus of claim 8, wherein the drive means is a lever.

10. The apparatus of claim 9 wherein the stabilizing means is a stud fastened to the frame, the stud being adapted to engage an aperture in the support and to engage a different aperture than the apertures through which the flexible hoisting means will pass.

11. The apparatus of claim 10, wherein the stud is a first stud, and there is at least one additional stud fastened to the frame, the at least one additional stud being adapted to engage an aperture in the support and to engage a different aperture than both (a) the aperture that the first stud engages and (b) the apertures that the flexible hoisting means will pass through.

12. The apparatus of claim 1, further comprising a rotation control means for controlling the rotation of the drum.

13. The apparatus of claim 12, wherein the rotation control means controls the rotation of the drum in a selected one of two directions.

14. The apparatus of claim 12, wherein the rotation control means is a ratchet.

15. The apparatus of claim 14, wherein the drive means is a lever.

16. The apparatus of claim 15 wherein the stabilizing means is a stud fastened to the frame, the stud being adapted to engage an aperture in the support and to engage a different aperture than the apertures through which the flexible hoisting means will pass.

17. The apparatus of claim 16, wherein the stud is a first stud, and there is at least one additional stud fastened to the frame, the at least one additional stud being adapted to engage an aperture in the support and to engage a different aperture than both (a) the aperture that the first stud engages and (b) the apertures that the flexible hoisting means will pass through.

18. The apparatus of claim 1, wherein the frame is comprised of iron.

19. The apparatus of claim 1, wherein the flexible hoisting means are selected from a group consisting of cables, straps, chains, ropes and belts.

20. The apparatus of claim 19 wherein the flexible hoisting means are straps.

21. The apparatus of claim 1 wherein the stabilizing means is a stud fastened to the frame, the stud being adapted to engage an aperture in the support and positioned to engage a different aperture than the apertures through which the flexible hoisting means will pass.

22. The apparatus of claim 21, wherein the stud is comprised of a fixed part fastened to the frame, and an adaptor that reversibly connects to the fixed part.

23. The apparatus of claim 21, wherein the stud is a first stud, and there is at least one additional stud fastened to the frame, the at least one additional stud being adapted to engage an aperture in the support and positioned to engage a different aperture than both (a) the aperture that the first stud engages and (b) the apertures that the flexible hoisting means will pass through.

24. The apparatus of claim 23, wherein the at least one additional stud is comprised of a fixed part that is fixedly fastened to the frame, and an adaptor that reversibly connects to the fixed part.

25. The apparatus of claim 1, wherein the drive means is a lever.

26. The apparatus of claim 1 wherein the drive means is an electric or hydraulic device.

27. A method for lifting an elongated blade that has a plurality of apertures from the ground to a support that has a plurality of apertures that correspond with the apertures on the blade, said method comprising:

(a) providing at least two flexible hoisting means, each said flexible hoisting means comprising a free end and a fixed end;

(b) inserting the free end of each flexible hoisting means through an aperture on the support, said apertures being different from one another;

(c) inserting the free end of each flexible hoisting means through a corresponding aperture on the blade;

(d) modifying the free end of each flexible hoisting means so that it is no longer capable of passing through the aperture on the blade;

(e) providing at least one drum to which each fixed end is attached, and onto which each flexible hoisting means can be wound;

(f) winding the flexible hoisting means onto the at least one drum until the blade abuts the support; and (g) securing the blade to the support.

28. The method of claim 27, wherein at step (d) the free end is modified by securing it near the fixed end, to thereby create a sling in which the blade will be supported.

29. The method of claim 27, wherein during step (f), the angle of the blade relative to the support is adjusted so that it will about the support at the selected angle.

30. A method for lowering an elongated blade from a support to the ground, said support and blade being coupled together by a plurality of bolts that pass through corresponding apertures in the support and blade, said method comprising:

(a) removing the bolts from selected apertures in the support;

(b) providing at least two flexible hoisting means, each said flexible hoisting means comprising a free end and a fixed end;

(c) inserting the free end of each flexible hoisting means through an aperture on the support and the corresponding aperture on the blade, said apertures on the support being different from one another;

(d) modifying the free end of each flexible hoisting means so that it is no longer capable of passing through the aperture on the blade;

(e) providing at least one drum to which each fixed end is attached, and onto which each flexible hoisting means is wound;

(f) removing all bolts remaining in the apertures of the support and blade, and (g) unwinding the flexible hoisting means from the at least one drum until the blade rests on the ground.

* * * * *